US006817133B1

(12) United States Patent
Williams

(10) Patent No.: US 6,817,133 B1
(45) Date of Patent: Nov. 16, 2004

(54) CARTRIDGE LOADER

(76) Inventor: Lawrence R. Williams, 2644 W. Campo Allegre, Mesa, AZ (US) 85202

( * ) Notice: Subject to any disclaimer, the term of this patent is extended or adjusted under 35 U.S.C. 154(b) by 0 days.

(21) Appl. No.: 10/412,091

(22) Filed: Apr. 10, 2003

(51) Int. Cl.[7] ..... F41A 9/61
(52) U.S. Cl. ..... 42/87
(58) Field of Search ..... 42/87

(56) References Cited

U.S. PATENT DOCUMENTS 211,691 A * 1/1879 Bennett ..... 42/87
391,811 A * 10/1888 Mixter ..... 42/87
869,484 A * 10/1907 Drake ..... 42/87
912,643 A * 2/1909 Bengtson ..... 42/87
1,095,801 A * 5/1914 Browning ..... 42/87
4,509,284 A * 4/1985 Naber ..... 42/87
4,756,110 A * 7/1988 Beltron ..... 42/87
4,862,621 A * 9/1989 Kearney ..... 42/87
6,185,853 B1 * 2/2001 Sniezak et al. ..... 42/87

* cited by examiner

*Primary Examiner*—Jack Keith
*Assistant Examiner*—M. Thomson
(74) *Attorney, Agent, or Firm*—Gregory J. Nelson

(57) ABSTRACT

A cartridge loader for loading rimmed cartridges into the magazine of a rifle. The loader has a tube with an exterior slide. The slide is coupled to a pusher within the tube which when manually advanced will deliver cartridges to the end of the tube and through the loading port of a firearm when the loader is positioned against the firearm receiver. The front end of the loader is configured to maintain the loading port gate open during the loading operation. The loader will accommodate a range of cartridge calibers.

8 Claims, 2 Drawing Sheets

50
46
30
14
48

M
R
P
F
G

C
22
70
10
14
10
16
C
6
32
6
30

28
26
32
25

28
26
32

20
10
14
22
40
42
45

CARTRIDGE LOADER

FIELD OF THE INVENTION

The present invention relates to a cartridge loader and, more particularly, relates to a loader for loading of rimmed firearm cartridges through the loading port gate into the magazine of a firearm.

BACKGROUND OF THE INVENTION

Firearms, particularly rifles of the lever-action type, generally have a tubular magazine which extends along or beneath the barrel and which will hold a number of cartridges. The cartridges are loaded into the magazine through a loading port and gate in the side of the receiver which requires the user to insert the cartridges one by one until the magazine is filled or the desired number of cartridges have been loaded. In order to transfer a cartridge from its position in the magazine to a firing position in the chamber, the action of the rifle, such as a lever action, is operated to feed the cartridge into the breach. Rifles of this type are common and may typically range in calibers from 0.30, 0.45 to 0.70 and larger in some custom made firearms.

A review of the prior art discloses a number of devices to assist in the loading of cartridges into a firearm. Most of these are of the speed loader type designed for shotguns. These types of devices are represented by U.S. Pat. No. 4,509,284 which has flexible tube with a slot which holds the shells until discharged by means of a plunger which moves within the tube.

A loading device for rifles is shown in U.S. Pat. No. 869,484 which is directed to a simple compact, inexpensive carrier for cartridges. The cartridges align longitudinally in the carrier and the carrier will transfer the cartridges by a single movement to the magazine of the rifle in position for feeding the firing chamber.

Another early patent, U.S. Pat. No. 391,811 entitled "Charger for Magazine Firearms" is directed to an implement which carries a series of cartridges which can be easily introduced into the magazine of firearm having a spring mechanism to force the cartridges through the tube.

While devices as described above exist, there nevertheless exists a need for a simple, inexpensive and easy to use device which may be utilized to rapidly and expediently load cartridges through the loading port and gate of a firearm into the magazine.

BRIEF SUMMARY OF THE INVENTION

Briefly, the present invention provides a cartridge loader which can be used to load rimmed cartridges of different calibers and is adapted for use with firearms, such as lever action rifles. The loader device of the present invention will assist in performing the operation of loading shells or cartridges into the tubular magazine of the rifle quickly without the user having to insert the cartridges one at a time through the loading gate.

The loader of the present invention consists of an elongate tube defining a loading chamber. The diameter of the loading chamber is preferably approximately ½" to ¾" and will accommodate a range of cartridges from the smaller 0.30 caliber up to larger cartridges such as 0.45 to 0.70 caliber. The front end of the tube is open so that the cartridges may be quickly and easily inserted into the loading chamber with the manual slide in the retracted position. A longitudinal slot extends in the side wall of the tube. A slide is manually moveable along the tube. The slide is attached to a pusher within the tube by a fastener extending through the slot. Thus, when the user advances or retracts the slide, the pusher will similarly be advanced or retracted. The nose of the pusher will engage the base of the rear cartridge. The configuration of the pusher nose is selected so that the nose of the pusher will contact the base of the rimmed cartridge in the area outside the primer located in the base. As the slide is moved forwardly toward the front end of the tube, the movement of the pusher will cause cartridges to be advanced and discharged into the magazine.

The front end of the tube has a surface which is angular so that the tube may be placed against the side of the rifle at the loading port with the tube extending outwardly with respect to the firearm. The angled surface of the discharge end has a projecting tip which preferably has a lip that will engage and hold the gate in an open position when the loader is engaged at the side of the firearm. With the gate in the open position, the cartridges will be advanced from the loading tube through the gate into the magazine until all or a selected number of cartridges have been inserted in the magazine. The pusher, in the forward position, will project into the loading port to fully insert the cartridges into the magazine.

BRIEF DESCRIPTION OF THE DRAWINGS

The above and other objects and advantages of the present invention will become more apparent from the following description, claims and drawings in which:

DETAILED DESCRIPTION OF THE DRAWINGS

Figures 1, 2, 3, 4, 5, 6:
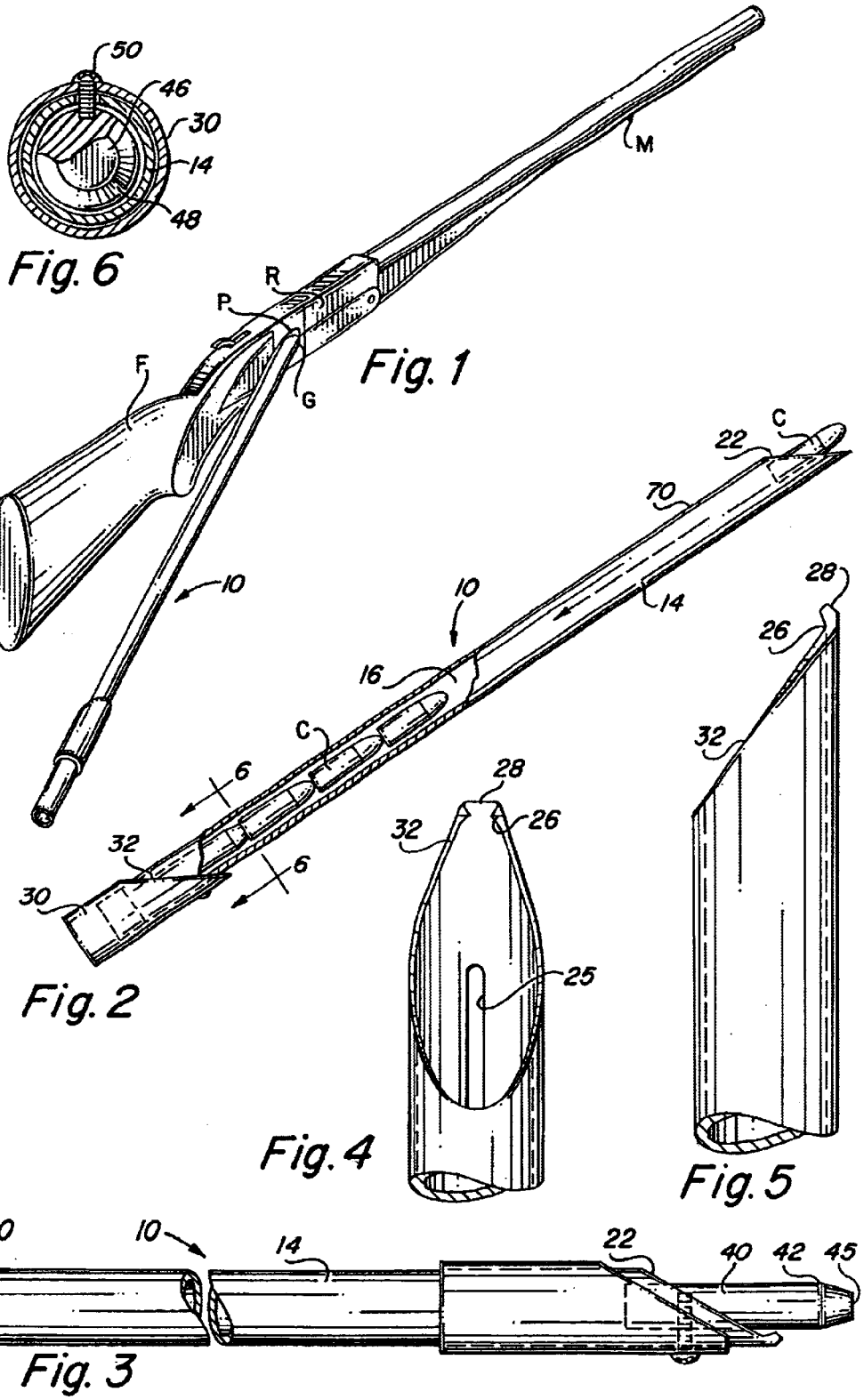
FIG. 1 is a perspective view showing the loader of the present invention positioned in a loading position with respect to a representative rifle.
FIG. 2 is a longitudinal view of the loader of the present invention partly broken away to better illustrate the details of construction.
FIG. 3 is a top view of the forward or loading end of the loader of the present invention.
FIG. 4 is an enlarged side view of the forward or loading end of the loader of the present invention.
FIG. 5 is a longitudinal view showing the loader of the present invention with the slide and pusher in a forward position.
FIG. 6 is a cross-sectional view taken along line 6—6 of FIG. 2.

Turning to the drawings, the cartridge loader of the present invention is generally indicated by the numeral 10 and in FIG. 1 is shown in conjunction with a firearm F, such as a rifle, of the lever action type. The firearm F has a receiver R and an elongate magazine M extending along the barrel. Shells are introduced into the magazine through port P having a spring-loaded gate G. Normally, the user will insert cartridges one at a time through the gate inserting the bullet end of the cartridge first. The gate is normally spring-loaded and is depressed to an out-of-the-way position by the cartridge as it is inserted.

The cartridge loader 10 has a body 14 which is shown as a generally elongate tube defining a cartridge receiving chamber 16. The tubular body may be constructed of any suitable material such as metal or a plastic such as PVC. The dimensions of the tube may vary but typically the loading tube is approximately 30" inches long having an internal diameter of approximately ½" which will accommodate a range of cartridges from 0.30 caliber to 0.45 to 0.70 caliber.

The cartridge loading tube has an open rear end 20 and a front end 22 located at opposite ends of the loading chamber 16. Cartridges are inserted into the loader at the front end and are also discharged from the front end 22 into the magazine.

A slot 25 extends axially substantially the full length of the tubular body starting about 1" inward of the rear end and terminating approximately 1" from the forward end of the tube.

A slide 30 is reciprocal along the length of the tube. The slide 30 is shown as a generally cylindrical member having an inner diameter slightly larger than the outer diameter of the tube. Slide 30 has a length so it can be comfortably grasped in one hand of the user and reciprocated along the longitudinal or axial slot. The forward end of the slide is beveled at 32 to conform to the angular configuration of the front end as will be explained.

Figures 7, 8:
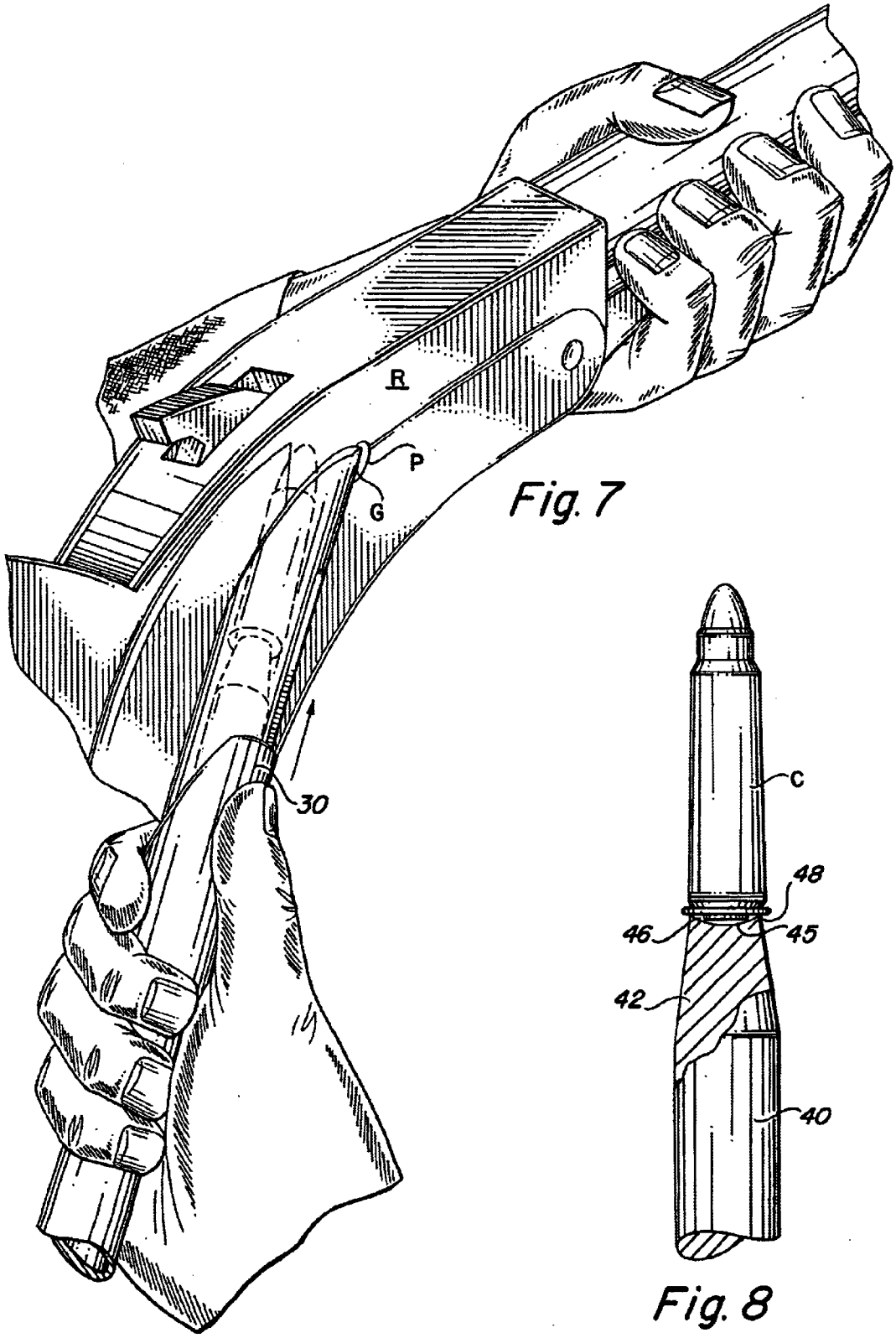
FIG. 7 is a perspective view showing the loader being manually held in a loading position.
FIG. 8 is a partial cross-sectional view of the nose of the pusher shown abutting the base of a cartridge.

A pusher 40 is disposed within the cartridge chamber. The pusher 40 is a tubular member of suitable material, such as nylon, having a forward nose 42 terminating at a surface 45. As seen in FIG. 8, the end surface 45 has a central recess 46 defining an annular rim 48. The annular rim 48 has a diameter selected so that when it is placed in abutment with the base of a shell cartridge C, the rim will have a diameter larger than the diameter of the cartridge primer in the base of the shell. The primer will normally align with the recess 46 in the surface 45 to avoid accidental firing of the cartridge.

The pusher 40 is secured to the exterior slide 30 by a fastener 50 shown as a screw which extends through the slide, through the slot 25 and into engagement with the pusher. It is preferred that the pusher be loosely held in the loading chamber. The screw will allow some slight pivotal motion of the pusher relative to the inner diameter of the chamber. The length and orientation of the pusher 40 with respect to the slide 30 is such that when the slide is in a fully forward position, the pusher will extend past the forward or discharge end 22 of the tube, as seen in FIG. 5.

FIGS. 3 and 4 show in detail the front end 22 of the loader. The front end has an edge 24 which is disposed at an acute angle with respect to the longitudinal axis of the tube. Preferably this angle is in the range of 30° to 45°. The tip 32 of the loader, which is aligned with the longitudinal slot in the tube, is slightly flattened at 28, as best seen in FIG. 3. The inner surface of the tip 32 is grooved at 26 so that the tip projects slightly forwardly and downwardly as seen in FIG. 4.

The user will then carefully insert the desired number of shells within the loading tube. This is accomplished by moving the slide 30 rearwardly which will also position the pusher in a rearward position. The screw 50 will engage the rear of the slot 25 in the rearward, loading position. The desired number of cartridges are gently inserted base end first through the discharge end. Appropriate markings may be applied adjacent the slot to indicate the number of cartridges of a particular caliber, as for example, the mark 70 indicates that nine rounds of 0.45 magnum shells would extend to this location. The slot in the tube will allow the user to easily see the number of cartridges as they are inserted into the loader. The mark 70 on the tube will assist the user in loading the proper number of shells. Appropriate markings for other calibers can also be applied along the slot 25. When the desired number of shells have been inserted into the loader, the loader is then held in the position as shown in FIG. 7. A right-handed individual would normally hold the rifle and loader with the left hand with the thumb over the gate and loader. This enables the user's right hand to grasp the slide 30. The slide is advanced and the forward pressure of the tip 28 against the loading gate will cause the loading gate to open to allow cartridges to be introduced through the loading gate into the magazine. The cartridges are advanced by moving the slide 30 forward. The loose connection between the pusher to the slide allows the pusher to seat against the base of various caliber shells. When the slide is in the full forward position, the pusher 40 extends or projects from the forward end of the tubular body 14 into the loading gate a sufficient distance to insure that all the cartridges are properly inserted in the magazine. The loader can then be removed and the rifle is ready to be fired once the lever action has been pumped to move a cartridge from the magazine into the breech.

As mentioned above, the loader is simple and will accommodate and may be used to load a variety of cartridges. The loader is light weight and may be easily stored. The elongate slot facilitates advancement of the manual slide and also allows the user to easily visualize the loading of cartridges into the loading chamber and the advancement of the cartridges into the magazine as the device is operated by moving the slide forward.

As mentioned above, the preferred material of the cartridge tube is a synthetic polymer such as polyvinyl chloride for ease of manufacture and lightness of weight. The cartridge tube can also be made of transparent material to allow the user to fully visualize the operation of the loader.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A loader for loading rimmed rifle cartridges having a center primer through a firearm having a cartridge loading gate comprising:

(a) a generally rigid, elongate tube defining a loading chamber to receive cartridges to be loaded, said tube having an open first end and defining a longitudinal extending slot;

(b) a pusher reciprocal within said chamber, said pusher having a nose which abuts the base of a cartridge, said nose defining a recess to receive the primer of the cartridge; and (c) a slide moveable along the exterior of said tube, said slide loosely coupled to said pusher to allow the pusher pivotal movement in said tube whereby manual advancement of said slide toward said first end will cause contained cartridges to be advanced to said first end of said tube, said slide being a generally cylindrical sleeve extending around the tube.

2. The loader of claim 1 wherein said first end is defined by a surface angularly disposed with respect to the longitudinal axis of the tube.

3. The loader of claim 2 wherein said first end has a projecting tip aligned with said slot.

4. The loader of claim 1 wherein said tube is plastic.

5. The loader of claim 1 wherein said tube is provided with markings to indicate the number of a particular caliber of cartridges contained within the tube.

6. The loader of claim 1 wherein said tube has a length of approximately 30".

7. The loader of claim 1 wherein said tube has an internal diameter of approximately ½" to ¾".

8. The loader of claim 1 wherein said pusher extends from the first end of the said tube when said slide is adjacent said first end.

* * * * *